US008164259B2

(12) United States Patent
Fukui et al.

(10) Patent No.: US 8,164,259 B2
(45) Date of Patent: Apr. 24, 2012

(54) PLASMA DISPLAY PANEL

(75) Inventors: Yusuke Fukui, Osaka (JP); Masahiro Sakai, Kyoto (JP); Mikihiko Nishitani, Nara (JP); Yosuke Honda, Osaka (JP); Michiko Okafuji, Osaka (JP); Yasuhiro Yamauchi, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/935,248

(22) PCT Filed: Jan. 13, 2010

(86) PCT No.: PCT/JP2010/000141

§ 371 (c)(1),
(2), (4) Date: Sep. 28, 2010

(87) PCT Pub. No.: WO2010/095344

PCT Pub. Date: Aug. 26, 2010

(65) Prior Publication Data

US 2011/0298363 A1 Dec. 8, 2011

(30) Foreign Application Priority Data

Feb. 18, 2009 (JP) ..... 2009-035244

(51) Int. Cl.
*H01J 17/49* (2006.01)

(52) U.S. Cl. ..... 313/582; 313/586

(58) Field of Classification Search ..... 313/582–587
See application file for complete search history.

(56) References Cited

U.S. PATENT DOCUMENTS

| | | | |
|---|---|---|---|
| 6,650,063 | B2 | 11/2003 | Uemura et al. |
| 2003/0090206 | A1 | 5/2003 | Uemura et al. |
| 2007/0152593 | A1 | 7/2007 | Kim et al. |
| 2011/0266949 | A1* | 11/2011 | Mizokami et al. ..... 313/587 |

FOREIGN PATENT DOCUMENTS

| | | |
|---|---|---|
| JP | 52-116067 | 9/1977 |
| JP | 2000-164143 | 6/2000 |
| JP | 2003-151446 | 5/2003 |
| JP | 2003-173738 | 6/2003 |
| JP | 2006-139999 | 6/2006 |
| JP | 2007-184264 | 7/2007 |
| JP | 2007-317486 | 12/2007 |
| JP | 2008-269939 | 11/2008 |

* cited by examiner

*Primary Examiner* — Anne Hines

(57) ABSTRACT

A first aim of the present invention is to provide a PDP capable of stably delivering favorable image display performance and being driven with low power, by improving the surface layer to improve secondary electron emission characteristics and charge retention characteristics. A second aim of the present invention is to provide a PDP, in addition to having the above-mentioned effects, capable of reducing an aging time. In order to achieve these aims, a crystalline film of a film thickness of approximately 1 μm is disposed as a surface layer (protective film) 8 on a surface of the dielectric layer 7 that faces a discharge space. The surface layer 8 is made by adding Sr to $CeO_2$, and a concentration of Sr in the surface layer 8 is in a range of 11.8 mol % to 49.4 mol % inclusive. With this structure, an attempt is made to improve the secondary electron emission characteristics and aging characteristics in the surface layer 8.

5 Claims, 12 Drawing Sheets

PLASMA DISPLAY PANEL

TECHNICAL FIELD

The present invention relates to a plasma display panel that makes use of radiation caused by gas discharges, and in particular to technology for improving the characteristics of a surface layer (protective film) that faces a discharge space.

BACKGROUND ART

Plasma display panels (hereinafter, referred to as "PDP"s) are flat display apparatuses that make use of radiation caused by gas discharges. PDPs can easily perform high-speed display and be large in size, and are widely used in fields such as video display apparatuses and public information display apparatuses. There are two types of PDPs, namely the direct current type (DC type) and alternating current type (AC type). In particular, surface discharge AC type PDPs have been commercialized due to having a great amount of technological potential in terms of lifetime and increases in size.

FIG. 12 is a schematic view showing a structure of discharge cells, or discharge units, of a general AC type PDP. The PDP 1*x* shown in FIG. 12 is constituted by a front panel 2 and a back panel 9 that are sealed together. The front panel 2 as a first substrate includes a front panel glass 3. A plurality of display electrode pairs 6, each composed of a scan electrode 5 and a sustain electrode 4, are disposed on one surface of the front panel glass 3. A dielectric layer 7 and a surface layer 8 are layered sequentially to cover the display electrode pairs 6. The scan electrode 5 and the sustain electrode 4 are respectively composed of transparent electrodes 51 and 41 and bus lines 52 and 42 layered thereon.

The dielectric layer 7 is made of low-melting glass with a softening point of approximately 550° C. to 600° C. and has a current limiting function that is peculiar to the AC type PDP.

The surface layer 8 protects the dielectric layer 7 and the display electrode pairs 6 from ion bombardment resulting from plasma discharge, efficiently emits secondary electrons in a discharge space 15 and lowers firing voltage of the PDP. Generally, the surface layer 8 is made, by the vacuum deposition method or the printing method, using magnesium oxide (MgO) that has high secondary electron emission characteristics, high sputtering resistance, and high optical transmittance. Note that, instead of the surface layer 8, a protective layer (also, referred to as a protective film) having the same structure as the surface layer 8 and exclusively for ensuring the secondary electron emission characteristics may be disposed.

On the other hand, the back panel 9 as a second substrate includes a back panel glass 10 and a plurality of data (address) electrodes 11, which are used for writing image data, disposed on the back panel glass 10 so as to intersect the display electrode pairs 6 at a right angle. On the back panel glass 10, a dielectric layer 12 made of low-melting glass is disposed to cover the data electrodes 11. Disposed on the dielectric layer 12, at the borders with the neighboring discharge cells (not illustrated), are barrier ribs 13 of a given height, made of low-melting glass. The barrier ribs 13 are composed of pattern parts 1231 and 1232 that are combined to form a grid pattern to partition a discharge space 15. Phosphor ink of either R, G, or B color is applied to the surface of the dielectric layer 12 and the lateral surfaces of the barrier ribs 13, and baked to form phosphor layers 14 (phosphor layers 14R, 14G, and 14B).

The front panel 2 and the back panel 9 are sealed together at opposing edge portions of both panels such that a longitudinal direction of the display electrode pairs 6 is orthogonal to a longitudinal direction of the data electrodes 11 with the discharge space 15 therebetween. The sealed discharge space 15 is filled with a rare gas such as Xe—Ne or Xe—He as a discharge gas, at a pressure of some tens of kPa. This concludes a description of the structure of the PDP 1*x*.

A gradation expression method (e.g. an intra-field time division gradation display method) that divides one field of an image into a plurality of subfields (S.F.) is used to display images in the PDP.

In recent years, electrical appliances are desired to be driven with low power, and the same desire exists for PDPs as well. In PDPs that display high definition images, discharge cells are made smaller in size and increased in number. Therefore, in order to surely produce write discharges, operating voltage is required to be increased in the small discharge spaces. The operating voltage of PDPs depends on a secondary electron emission coefficient ($\gamma$) of the surface layer. Here, $\gamma$ is a value that depends on materials of the surface layer and discharge gases, and $\gamma$ is known to increase as work functions of the materials decrease. Increased operating voltage becomes an obstacle to drive PDPs with low power. In view of this, Patent Literature 1 discloses a surface layer including (i) SrO as the main component and (ii) $CeO_2$, and technology for stably discharging SrO at low voltage.

[Citation List]

[Patent Literature]

[Patent Literature 1]

Japanese Patent Application Publication No. S52-116067

SUMMARY OF INVENTION

Technical Problems

It is difficult to say that, however, the above-mentioned conventional technology fully achieves the goal of actually driving the PDPs with low power.

In addition, there is a challenge of reducing an aging time required in the surface layer including $CeO_2$, which is longer than an aging time required in the surface layer including MgO.

Furthermore, a problem of "discharge delay" occurs in PDPs. Here, the "discharge delay" refers to a time lag that occurs between a rising edge in a voltage pulse and an actual discharge in a discharge cell during driving of the PDP. In the field of displays such as the PDPs, since information on image source has been increased as the PDPs have displayed high definition images, the number of scan electrodes (scan lines) on a display surface tends to be increased. A full-high-vision TV, for example, has more than twice as many scan lines as a conventional NTSC TV. In order to accurately display images in such a high definition PDP, the PDP needs to be driven at high speed as the information on image source has been increased. A sequence in a field is required to be driven at high speed, specifically, in 1/60 [s] or less.

For the high-speed drive, there is a method, for example, of narrowing down a width of pulses applied to the data electrodes in a write period of a sub-field.

However, driving the PDP at high speed by the above mentioned method will worsen the problem of the "discharge delay" will occur. As the pulse width is made narrower for the high-speed drive, the "discharge delay" is more likely to occur, because a chance that the discharge is completed in duration of the narrowed pulse is reduced. As a result, some cells are not lit (a lighting failure), and image display performance is compromised. In particular, in the PDP that has the surface layer of the amorphous structure as disclosed in Patent Literature 1, since initial electrons for suppressing the occurrence of the discharge delay are less likely to be emitted from the surface layer into a discharge space, degradation of image quality occurs more commonly due to the unlit cells.

As set forth above, there are still several problems to be solved in conventional PDPs.

The present invention has been achieved in view of the above problems. A first aim of the present invention is to provide a PDP capable of stably delivering favorable image display performance and being driven with low power, by improving the surface layer to improve secondary electron emission characteristics and charge retention characteristics.

A second aim of the present invention is to provide a PDP, in addition to having the above-mentioned effects, capable of stably delivering high image display performance in a case of displaying high-definition images at high speed, by preventing the occurrence of discharge delay during driving of the PDP.

Solution to Problem

In order to achieve the above aims, one aspect of the present invention is a plasma display panel having a first substrate and a second substrate that oppose each other and are sealed together at opposing edge portions thereof so as to enclose a discharge space, the first substrate including a plurality of display electrode pairs, the discharge space being filled with a discharge gas, wherein the first substrate includes a surface layer at a side thereof facing the discharge space, the surface layer including $CeO_2$ and Sr, a concentration of Sr in the surface layer being in a range of 11.8 mol % to 49.4 mol % inclusive.

Here, it is preferable that the concentration of Sr in the surface layer be in a range of 25.7 mol % to 42.9 mol % inclusive.

Furthermore, the first substrate may include MgO particles disposed on the surface layer so as to face the discharge space. That is to say, (i) the surface layer having the above-mentioned structure as a base layer and (ii) the MgO particles disposed on the surface layer having the above-mentioned structure so as to face the discharge space may constitute the surface layer as a whole.

The MgO particles can be produced by a gas phase oxidation method. Alternatively, the MgO particles can be produced by baking MgO precursors.

Advantageous Effects of Invention

The PDP in the present invention having the above-mentioned structure has the surface layer including (i) $CeO_2$ as the main component and (ii) Sr added at a predetermined concentration that does not lengthen an aging time. With this structure, an electron level attributable to Sr is introduced in a forbidden band.

Therefore, by making use of electrons trapped at the electron level attributable to Sr, energy that is obtained in so-called Auger neutralization process and is used for excitation of electrons in the surface layer can be increased during driving of the PDP having the above-mentioned structure. The use of the increased energy promotes significant improvement of secondary electron emission characteristics of the surface layer.

With this effect, since discharge can responsively be caused at relatively low firing voltage, the discharge delay can be prevented. Accordingly, it is expected that a PDP capable of delivering excellent image display performance and being driven with low power is realized.

Furthermore, in the surface layer, since the electron level attributable to Sr exists at a certain depth (i.e. a depth energetically not too shallow) from the vacuum level, electrons trapped at the electron level cannot easily be released. As a result, the occurrence of so-called "excessive charge loss" problem is reduced. Here, the "excessive charge loss" is a phenomenon in which an excessive number of electrons are emitted from the surface layer during driving of the PDP. When appropriate charge retention characteristics are exhibited in the surface layer as described above, it becomes possible to emit secondary electrons into a discharge space for a long time.

Note that the surface layer including (i) a layer having the above-mentioned structure as a base layer and (ii) a group of MgO particles, which are produced by a gas phase oxidation method, a precursor baking method and the like, disposed on the base layer, can further improve the secondary electron emission characteristics and suppress the discharge delay. Additionally, the surface layer having the above-mentioned structure can improve initial electron emission characteristics during firing.

Therefore, even when a PDP having high resolution cells each having a very small discharge space therein is driven at high speed, discharge can be caused by making use of abundant electrons in each discharge space. Additionally, it is expected that display responsiveness is increased, and the problems of discharge delay and temperature dependency of the discharge delay are remedied. As a result, excellent image display performance can be achieved. Furthermore, it becomes possible to stably drive the PDP over wide temperature ranges.

DESCRIPTION OF EMBODIMENTS

The following describes preferred embodiments and examples of the present invention. Note that the present invention is never limited to these, and various changes may be made as necessary without departing from the technical scope of the present invention.

[Embodiment 1]

(Exemplary Structure of the PDP)

Figure 1:
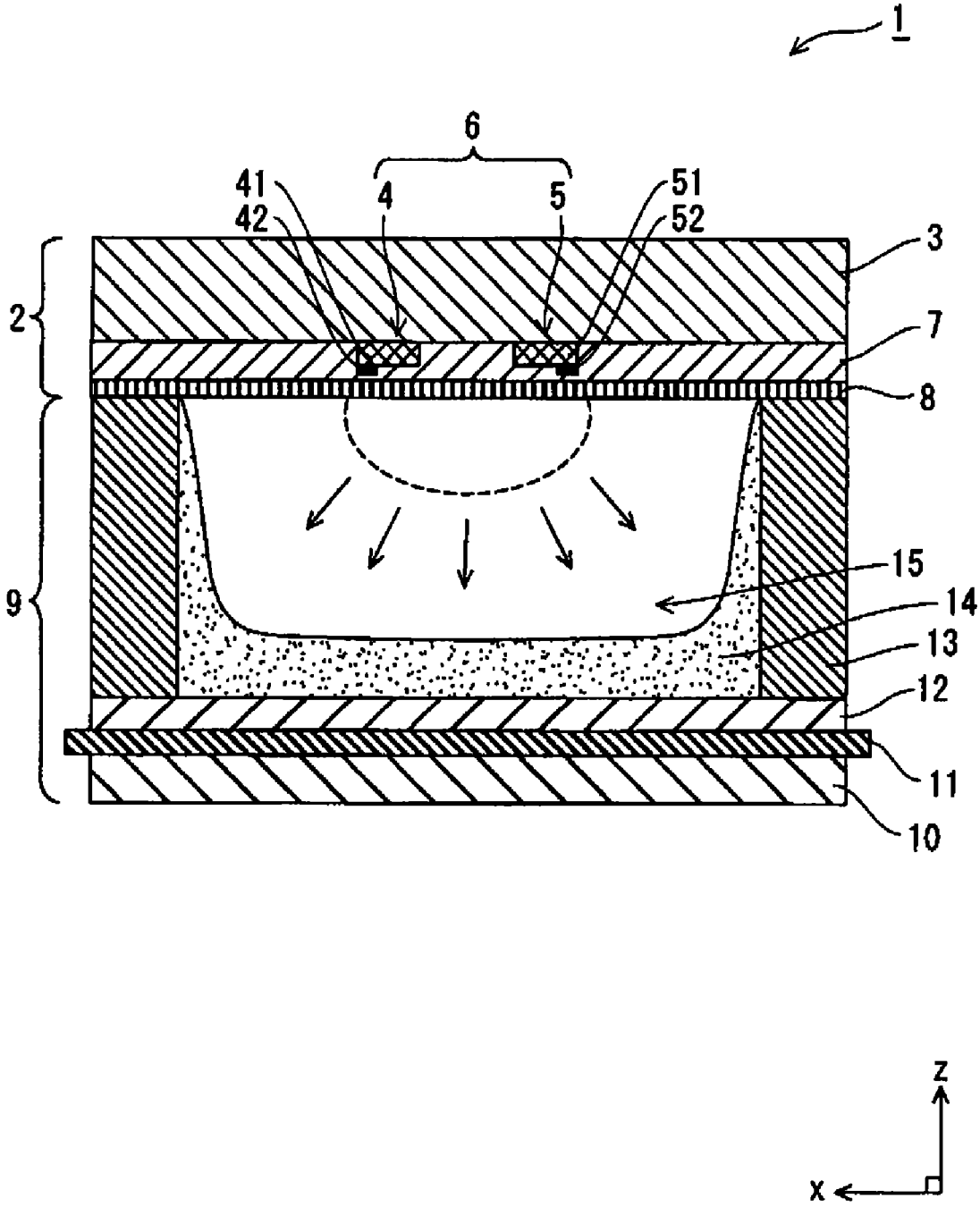
FIG. 1 is a cross-sectional view showing a structure of a PDP pertaining to Embodiment 1 of the present invention.

FIG. 1 is a schematic sectional view along an x-z plane of the PDP 1 pertaining to Embodiment 1 of the present invention. The structure of the PDP 1 is similar to the structure (FIG. 4) of a conventional PDP except for the structure in the vicinity of the surface layer 8.

The PDP 1 is an AC type PDP with a 42-inch screen in conformity with the NTSC specification. The present invention may be, of course, applied to other specifications such as XGA and SXGA. The applicable specifications of a high-definition PDP capable of displaying images at an HD (high-definition) resolution or higher are PDPs with a panel size of 37, 42, and 50 inches having 1024×720 (pixels), 1024×768 (pixels), and 1366×768 (pixels), respectively. In addition, a panel with an even higher resolution than these HD panels may also be used. Examples of a PDP having a higher definition than an HD PDP include a full HD PDP with a resolution of 1920×1080 (pixels).

As shown in FIG. 1, the PDP 1 is substantially composed of two members: a first substrate (front panel 2) and a second substrate (back panel 9) that oppose each other in face-to-face relationship.

The front panel 2 includes a front panel glass 3 as its substrate. On one main surface of the front panel glass 3, a plurality of display electrode pairs 6 (each composed of a scan electrode 5 and a sustain electrode 4) are disposed with a given discharge gap (75 μm) in-between. Each display electrode pair 6 is composed of a transparent electrode 51 or 41 and a bus line 52 or 42 layered thereon. Transparent electrodes 51 and 41 (0.1 μm thick, 150 μm wide) are disposed in a stripe made of transparent conductive materials such as indium tin oxide (ITO), zinc oxide (ZnO), and tin oxide ($SnO_2$). The bus lines 52 and 42 (7 μm thick, 95 μm wide) are made of an Ag thick film (2 μm to 10 μm thick), an Al thin film (0.1 μm to 1 μm thick), a Cr/Cu/Cr layered thin film (0.1 μm to 1 μm thick) or the like. These bus lines 52 and 42 reduce the sheet resistance of the transparent electrodes 51 and 41.

The term "thick film" refers to a film that is formed by various kinds of thick-film forming methods. In thick-film forming methods, a film is formed by applying a paste or the like containing conductive materials and then baking the paste. The term "thin film" refers to a film that is formed by various kinds of thin-film forming methods using vacuum processing such as a sputtering method, ion plating method, or electron-beam deposition method.

On the entire main surface of the front panel glass 3 where the display electrode pairs 6 are disposed, a dielectric layer 7 is formed with use of a screen printing method or the like. The dielectric layer 7 is made of low-melting glass (35 μm thick) that contains lead oxide (PbO), bismuth oxide ($Bi_2O_3$) or phosphorus oxide ($PO_4$) as the main component.

The dielectric layer 7 has a current limiting function that is peculiar to the AC type PDP, which is why the AC type PDP can last longer than the DC type PDP.

On one surface of the dielectric layer 7, the surface layer 8 of a film thickness of approximately 1 μm is disposed. The surface layer 8 is applied for the purpose of protecting the dielectric layer 7 from ion bombardment at the time of discharge and lowering the firing voltage. The surface layer 8 is formed with a material that has high sputtering resistance and a high secondary electron emission coefficient γ. The material is required to provide excellent optical transmittance and electrical insulation.

The present invention is characterized mainly by the surface layer 8. The surface layer 8 includes $CeO_2$ as the main component, and Sr is added to the surface layer 8 such that the concentration of Sr in the surface layer is in a range of 11.8 mol % to 49.4 mol % inclusive. The surface layer 8 as a whole is a crystalline film in which a microcrystalline structure and/or a crystalline structure of $CeO_2$ are held. Ce is added to introduce an electron level in a forbidden band in the surface layer 8 as will be described later. It was found that more preferable concentration of Sr is 25.7 mol % to 42.9 mol % inclusive. Due to Sr elements added to the surface layer 8, improved secondary electron emission characteristics and charge retention characteristics are exhibited in the surface layer 8, and stable driving with low power becomes possible because of reduced operating voltage (mainly firing voltage and sustain voltage).

When the concentration of Sr is considerably lower than 11.8 mol %, secondary electron emission characteristics and charge retention characteristics in the surface layer 8 are not sufficiently exhibited, and a long time is required for aging. For this reason, such concentration is not preferred. On the other hand, when the concentration of Sr is considerably higher than 49.4 mol %, a crystalline structure of the surface layer 8 changes from a fluorite structure of $CeO_2$ to an amorphous structure, or to an NaCl structure of SrO. In this case, since surface stability of $CeO_2$ is degraded, secondary electron emission characteristics are not sufficiently exhibited. Additionally, a long time is required for aging to remove contaminants on the surface. For the above-mentioned reasons, in order to achieve driving with low power and reduce an aging time, it is important that the concentration of Sr falls within a range of 11.8 mol % to 49.4 mol % inclusive, as described above.

Since a peak can be observed in a position similar to that of the peak of pure $CeO_2$ in thin film X-ray diffraction measurement in which a CuKα-ray is used as a radiation source, it is confirmed that the surface layer 8 has at least a fluorite structure similarly to $CeO_2$. Since an ionic radius of Sr is very different from an ionic radius of Ce, when the surface layer 8 includes high concentration of Sr (too large amount of Sr is added), the fluorite structure of $CeO_2$ collapses. In the present invention, however, by properly regulating the concentration of Sr, the crystalline structure (fluorite structure) of the surface layer 8 is maintained.

The back panel 9 includes a back panel glass 10 as its substrate. On one main surface of the back panel glass 10, data electrodes 11 each with a width of 100 μm are formed in a stripe pattern having a fixed gap (360 μm) therebetween. The data electrodes 11 are adjacent to each other in the y direction, and each extends in the x direction longitudinally. The data electrodes 11 are made of any one of an Ag thick film (2 μm to 10 μm thick), an Al thin film (0.1 μm to 1 μm thick), a Cr/Cu/Cr layered thin film (0.1 μm to 1 μm thick), or the like. The dielectric layer 12 with a thickness of 30 μm is disposed on the entire surface of the back panel glass 9 to enclose the data electrodes 11.

On the dielectric layer 12, the grid-shaped barrier ribs 13 (approximately 110 μm high and 40 μm wide) are each disposed above the gap between the adjacent data electrodes 11. The barrier ribs 13 prevent erroneous discharge or optical crosstalk by partitioning the discharge cells.

On the lateral surfaces of two adjacent barrier ribs 13 and on the surface of the dielectric layer 12 between the lateral surfaces, a phosphor layer 14 corresponding to either red (R), green (G) or blue (B) color is formed for color display. Note that the dielectric layer 12 is nonessential and that the phosphor layer 14 may directly cover the data electrodes 11.

The front panel 2 and the back panel 9 are disposed with a space therebetween such that a longitudinal direction of the data electrodes 11 and a longitudinal direction of the display electrode pairs 6 are orthogonal to each other in plan view. The outer peripheral edge portions around the panels 2 and 9 are sealed with glass frit. In the space between the panels 2 and 9, a discharge gas composed of inert gases such as He, Xe and Ne is enclosed at a given pressure.

Between the barrier ribs 13 is a discharge space 15.

Where the adjacent display electrode pairs 6 intersect a data electrode 11 via the discharge space 15 corresponds to a discharge cell (also referred to as a "sub-pixel") that functions to display images. The discharge cell pitch is 675 μm in the x direction and 300 μm in the y direction.

Three adjacent discharge cells whose colors are red, green and blue compose one pixel (675 μm×900 μm).

Figure 2:
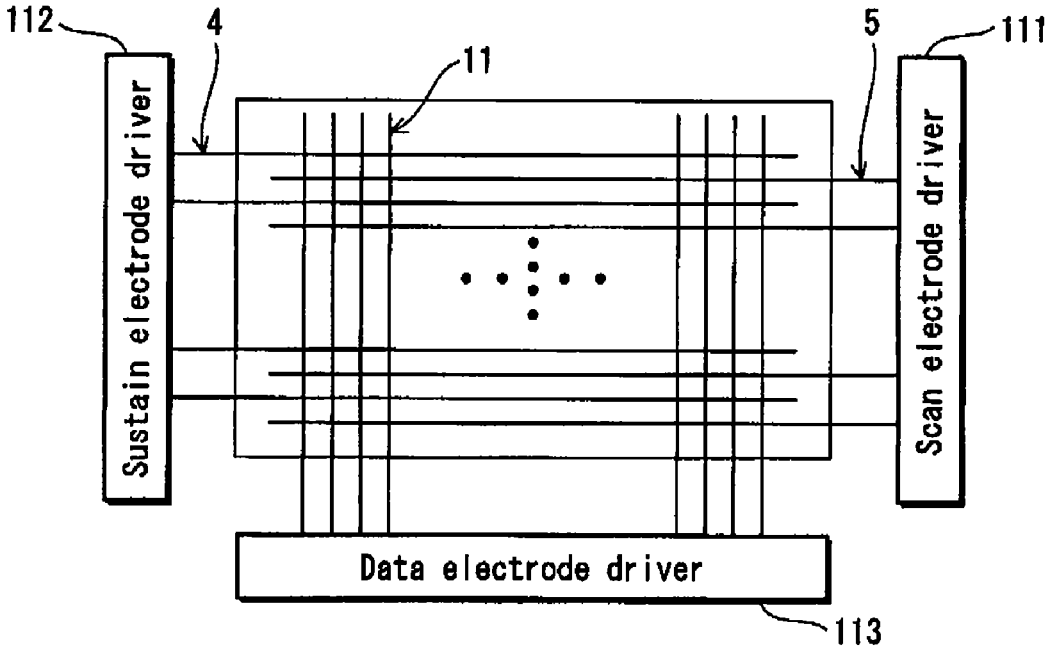
FIG. 2 is a schematic view showing a relation between electrodes and drivers.

As shown in FIG. 2, the scan electrodes 5, the sustain electrodes 4 and the data electrodes 11 are respectively connected to a scan electrode driver 111, a sustain electrode driver 112 and a data electrode driver 113 that are included in a driving circuit, outside the panel.

(Example of the Driving of the PDP)

As soon as the PDP 1 with the above structure is driven, a heretofore-known driving circuit (not shown) including the drivers 111 to 113 applies an AC voltage ranging from tens to hundreds of kHz between the display electrode pairs 6 to generate discharge in selectable discharge cells. As a result, ultraviolet rays (shown as the dotted line and the arrows in FIG. 1) mainly including resonance lines with wavelengths of mainly 147 nm emitted by the excited Xe atoms and molecular lines with wavelengths of mainly 172 nm emitted by the excited Xe molecules irradiate the phosphor layers 14. Accordingly, the phosphor layers 14 are excited to emit visible light. The visible light then penetrates the front panel 2 and radiates forward.

As an example of the driving, the intra-field time division gradation display method is adopted. This method divides one field of an image into a plurality of subfields (S.F.), and further divides each subfield into a plurality of periods. One subfield is divided into four periods: (1) an initialization period for resetting all the discharge cells to an initial state, (2) a write period for selectively addressing the discharge cells to place the respective discharge cells into a state corresponding to image data input, (3) a sustain period for causing the addressed discharge cells to emit light, and (4) an erase period for erasing wall charges accumulated as a result of the sustain discharge.

In each subfield, the following occurs so that the PDP 1 emits light to display an image. In the initialization period, an initialization pulse resets wall charges in all discharge cells of the entire panel. In the write period, a write discharge is generated in the discharge cells that are intended to light. Subsequently in the sustain period, an AC voltage (sustain voltage) is applied to all the discharge cells simultaneously. Thus, the sustain discharge is generated in the given length of time so as to display the image.

Figure 3:
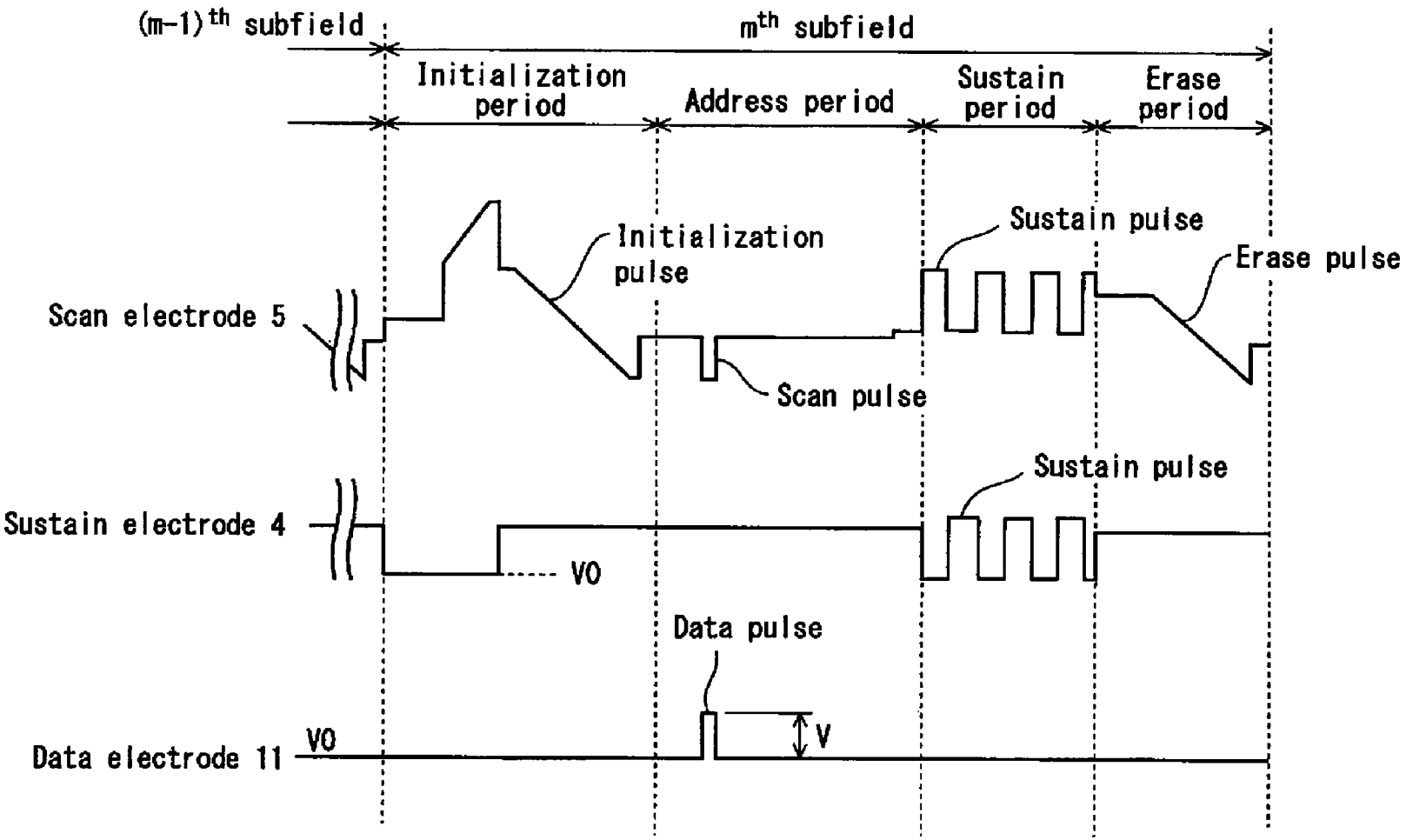
FIG. 3 shows examples of driving waveforms of the PDP.

FIG. 3 shows an example of driving waveforms in the $m^{th}$ subfield of one field. As shown in FIG. 3, each subfield is divided into the initialization period, the write period, the sustain period and the erase period.

The initialization period is set for erasing the wall charges in all discharge cells of the entire panel (initialization discharge) so as not to be influenced by the discharge generated prior to the $m^{th}$ subfield (influence of the accumulated wall charges). In the example of the driving waveforms in FIG. 3, a higher voltage (initialization pulse) is applied to the scan electrode 5 than the data electrode 11 and the sustain electrode 4 to cause the gas in the discharge cell to discharge. As a result, electric charges generated by the discharge are accumulated on the wall surface of the discharge cells in order to nullify the potential difference among the data electrodes 11, the scan electrodes 5 and the sustain electrodes 4. Therefore, on the surface of the surface layer 8 around the scan electrodes 5, negative charges are accumulated as wall charges. On the other hand, positive wall charges are accumulated on the surface of the phosphor layers 14 around the data electrodes 11 and on the surfaces of the surface layer 8 around the sustain electrodes 4. These wall charges cause a given value of wall potential between the scan 5 and data 11 electrodes as well as between the scan 5 and sustain 4 electrodes.

The write period is set for addressing the discharge cells that are selected according to image signals divided into subfields (specifying the discharge cells to light or not). In this period, a lower voltage (scan pulse) is applied to the scan electrodes 5 than to the data electrodes 11 or the sustain electrodes 4 in order to light the intended discharge cells. Specifically, a data pulse is applied between the scan 5 and data 11 electrodes in the same polar direction as the wall potential, as well as between the scan 5 and sustain 4 electrodes in the same polar direction as the wall potential, and thus, the write discharge is generated. As a result, negative charges are accumulated on the surface of the phosphor layers 14, on the surface of the surface layer 8 around the sustain electrodes 4, whereas positive charges are accumulated as wall charges on the surface of the surface layer 8 around the scan electrodes 5. Thus, a given value of the wall potential between the sustain 4 and scan 5 electrodes is generated.

The sustain period is set for sustaining the discharge by extending the lighting period of each discharge cell specified by the write discharge so as to keep luminance according to a gradation level. In this period, in the discharge cells that have the wall charges, a voltage pulse for sustain discharge (e.g. a rectangular waveform pulse of approximately 200 V) is applied to each electrode in a pair of a scan electrode 5 and a sustain electrode 4, such that the pulses are out of phase with each other. Thus, a pulse discharge is generated in the addressed discharge cells every time when the polarities reverse at the electrodes.

Due to the sustain discharge, in the discharge space, resonance lines having wavelengths of 147 nm are emitted from the excited Xe atoms, and molecular lines of mainly 173 nm are emitted from the excited Xe molecules. Thus, these resonance lines and molecular lines are radiated to the surface of the phosphor layers 14 and converted into visible light, and the image is displayed on the screen. The ON-OFF combinations of the subfields of red, green and blue colors enable an image to be displayed in multiple colors and gradations. Note that in the discharge cells in which the wall charges are not accumulated on the surface layer 8, the sustain discharge is not generated, and the discharge cells display black images.

In the erase period, an erase pulse of a declining waveform is applied to the scan electrodes 5, which erases the wall charges.

(Reduction of Discharge Voltage)

The following describes a reason why the PDP 1 having the above-mentioned structure pertaining to Embodiment 1 can be driven at lower voltage than voltage applied to drive a conventional PDP.

The magnitude of the discharge voltage of a PDP depends on how many electrons are emitted from the surface layer (electron emission characteristics). Dominant process of emitting electrons from the surface layer is as follows. Neon and xenon as discharge gases are excited during driving, and, upon receiving energy obtained by the Auger effect produced by the excitation, secondary electrons are emitted from the surface layer.

Figure 4:
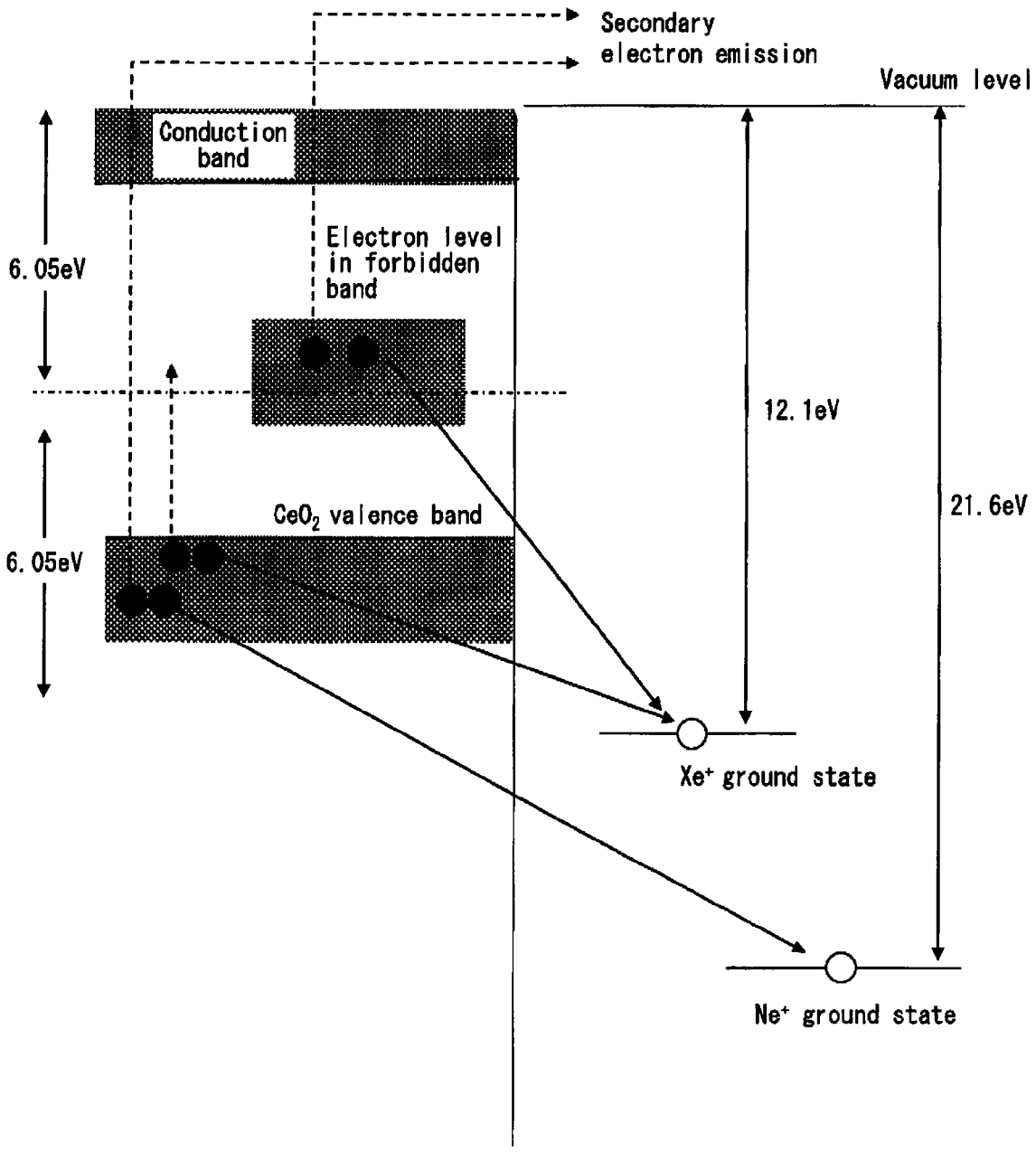
FIG. 4 is a schematic view showing an electron level unique to $CeO_2$ and how secondary electrons are emitted in the Auger process.

FIG. 4 is a schematic view showing an electron level in the surface layer made of $CeO_2$. As shown in FIG. 4, electrons in the vicinity of the valence band play prominent roles in electron emission from the surface layer.

In the case where neon (Ne), which has relatively high ionization energy, is used as a discharge gas, upon excitation of Ne during driving, electrons are brought back to a ground state of Ne (an electron on the right end of FIG. 4). Energy (21.6 eV) obtained by the Auger effect at the time is received by electrons in a valence band in the surface layer. The amount of energy (21.6 eV) obtained in the process is sufficient to emit electrons in the valence band as secondary electrons.

On the other hand, in the case where xenon (Xe), which has relatively low ionization energy, is used as a discharge gas, upon excitation of Xe electrons during driving, electrons are brought back to a ground state of Xe as in the case of Ne. However, the amount of energy (12.1 eV) obtained by the Auger effect and received by electrons in the valence band is insufficient to emit electrons. In this case, the probability of discharge is greatly reduced. As a result, the concentration of Xe in the discharge gas rises, and thus operating voltage is significantly increased. This becomes a major problem when large amount of Xe is used as the discharge gas.

In general, in the surface layer made using $CeO_2$, as shown in FIG. 4, an electron level that is more susceptible to the Auger effect and considered to be Ce4f is introduced in a $CeO_2$ forbidden band. (See, "electron level in forbidden band" in FIG. 4). Because of the electron level, since energy obtained in the Auger neutralization process and used for excitation of electrons in the surface layer increases, the probability of emitting secondary electrons increases. As a result, abundant secondary electrons can be used in the discharge space 15. Therefore, operating voltage in a PDP that has the surface layer made of $CeO_2$ is reduced. Electrons existing at the electron level considered to be Ce4f, however, are smaller in number than electrons existing in a valence band. Additionally, the electron level is not stable. For these reasons, it is difficult to sufficiently reduce discharge voltage and stably maintain discharge for a long time.

Figure 5:
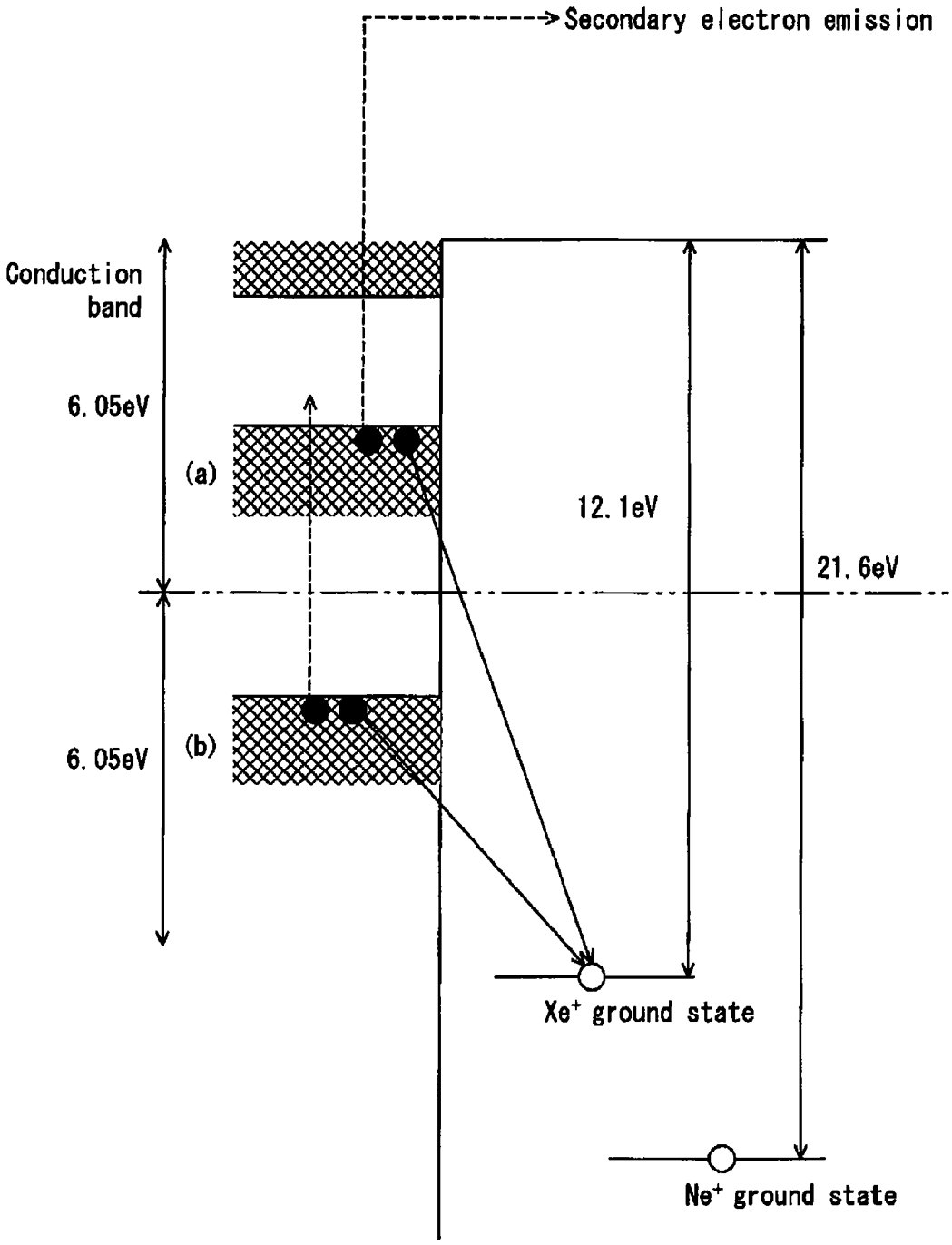
FIG. 5 is a schematic view showing electron levels in surface layers of the PDP pertaining to Embodiment 1 of the present invention and a conventional PDP, and how secondary electrons are emitted in the Auger process.

In view of this, the surface layer in Embodiment 1 of the present invention causes discharge at low voltage by adding Sr to $CeO_2$ and controlling the concentration of Sr (a ratio of the number of moles of Sr to the total number of moles of Sr and Ce) so as to fall within a range of 11.8 mol % to 49.4 mol % inclusive. As shown in FIG. 5, by adding Sr to the surface layer in Embodiment 1 of the present invention, an impurity level is introduced in the Ce4f forbidden band, and in addition, a level of the valence band is elevated from (b) to (a) in FIG. 5. As a result, since energy that is obtained in the Auger neutralization process and is used for excitation of electrons in the surface layer can be increased and the probability of emitting secondary electrons increases, it becomes possible to efficiently reduce discharge voltage. In this case, electrons that are involved in the Auger neutralization do not exist at the impurity level but exist in the valence band that can house therein a large number of electrons. Therefore, secondary electron emission characteristics can be stably exhibited. Through experiments conducted by the inventors, it was found that the more preferable concentration of Sr is 25.7 mol % to 42.9 mol % inclusive.

[Embodiment 2]

Figure 6:
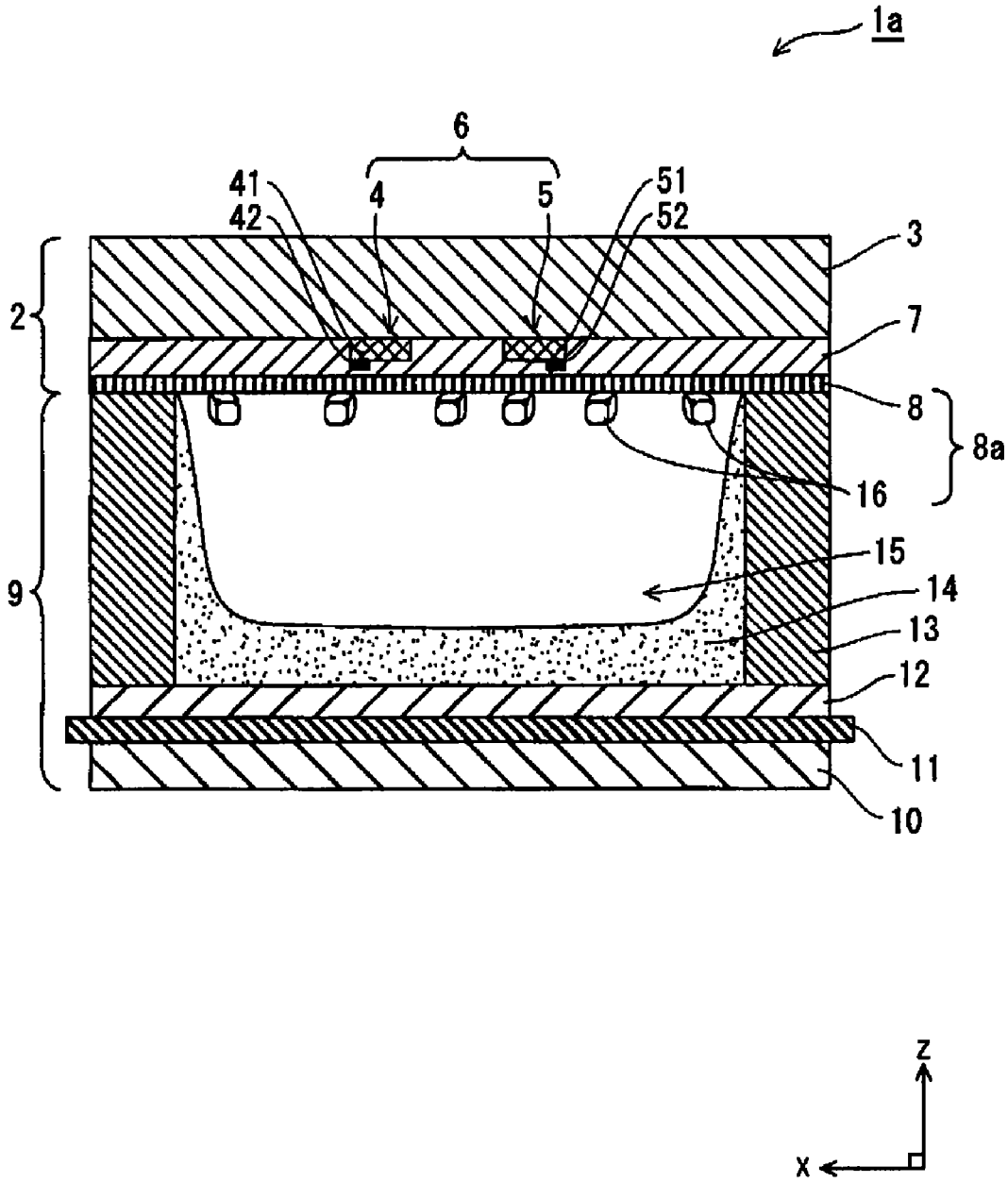
FIG. 6 is a cross-sectional view showing a structure of a PDP pertaining to Embodiment 2 of the present invention.

The following is a description of Embodiment 2 of the present invention, focusing on the differences with Embodiment 1. FIG. 6 is a cross-sectional view showing a structure of the PDP 1*a* pertaining to Embodiment 2.

Although having a similar basic structure to the PDP 1, the PDP 1*a* is characterized by having a surface layer 8*a* composed of (i) the surface layer 8 as a base layer 8 and (ii) MgO particles 16 having high initial electron emission characteristics and being dispersed on the surface of the surface layer 8. The density of the MgO particles 16 is determined, for example, such that the base layer 8 cannot be seen directly when the surface layer 8*a* in a discharge cell 20 is viewed along a Z direction. The density, however, is not limited to this. For example, the MgO particles 16 may be disposed on parts of the surface of the base layer 8. More specifically, the MgO particles 16 may be disposed on parts of the surface under which the display electrode pairs 6 are disposed.

Note that, in FIG. 6, sizes of the MgO particles 16 disposed on the base layer 8 are enlarged compared with the actual size in order to schematically show the structure of the PDP 1*a*. The MgO particles 16 may be produced by either a gas phase method or a precursor baking method. However, it was established by the inventors of the present application that the MgO particles 16 having good performance can be produced by the precursor baking method (described later).

In the PDP 1*a* having the above-mentioned structure, characteristics of the surface layer 8 and the MgO particles 16, which are functionally separated with each other, can be synergistically exhibited in the surface layer.

Specifically, as in the case of PDP 1, secondary electron emission characteristics are improved during driving due to the surface layer 8 to which Sr is added such that the concentration of Sr is in a range of 11.8 mol % to 49.4 mol % inclusive. As a result, operating voltage is reduced, and the PDP 1*a* can be driven with low power. Additionally, since the base layer 8 has excellent charge retention characteristics, the secondary electron emission characteristics can be stably exhibited for a long time even when the PDP 1*a* is continuously driven.

At the same time, in the PDP 1*a*, the initial electron emission characteristics are improved because of the MgO particles 16. Due to the improved initial electron emission characteristics, discharge responsiveness is dramatically improved, and thus the problems of the discharge delay and the temperature dependency of the discharge delay are expected to be reduced. This effect is particularly striking when the present invention is applied to a high-definition PDP and the high-definition PDP is driven at high speed using a narrowed pulse. In this case, excellent image display performance is delivered.

Note that, in the PDP 1*a*, since the surface of the base layer 8 is protected by the MgO particles 16, a problem of impurities that are included in the discharge space 15 and directly adhere to the surface of the base layer 8 can be reduced. This is expected to further improve life characteristics of the PDP.

(MgO Particles 16)

Through experiments conducted by the inventors of the present application, it was confirmed that the MgO particles 16 disposed on the PDP 1*a* mainly have an effect of suppressing the "discharge delay" caused in the write discharge and improving the temperature dependency of the "discharge delay". Consequently, in the PDP 1*a* in Embodiment 2, the MgO particles 16 are disposed to face the discharge space 15 as elements that emit initial electrons during driving, by making use of the fact that the MgO particles 16 have higher initial electron emission characteristics than the base layer 8.

The "discharge delay" is considered to be caused mainly by the shortage of initial electrons, which are triggers, being emitted from the surface of the surface layer 8 into the discharge space 15 during firing. In order to effectively emit initial electrons into the discharge space 15, the MgO particles 16 that emit an extremely larger number of initial electrons than the surface layer 8 are dispersed on the surface of the surface layer 8. With this structure, a large number of initial electrons needed in the address period are emitted from the MgO particles 16, and thus an attempt is made to solve the problem of the discharge delay. By improving the initial electron emission characteristics in this manner, the PDP 1*a* can be responsively driven at high speed even when the PDP 1*a* is a high-definition PDP.

Furthermore, with the structure in which the MgO particles 16 are disposed on the surface of the surface layer 8 as described above, it was found that the effect of improving the temperature dependency of the "discharge delay" can be achieved along with the effect of suppressing the "discharge delay".

As set forth above, in the PDP 1*a,* the surface layer is composed of (i) the surface layer 8 that enables driving of the PDP 1*a* with low power, and has secondary electron emission characteristics and charge retention characteristics and (ii) the MgO particles 16 having an effect of suppressing the discharge delay and the temperature dependency of the discharge delay. With this structure, the PDP 1 as a whole can be driven at high speed with low power even when the PDP 1 has high resolution discharge cells, and high-quality image display performance is expected to be achieved by inhibiting lighting failures in cells.

Furthermore, since the MgO particles 16 are dispersed on the surface of the surface layer 8, the MgO particles 16 have a consistent effect of protecting the surface layer 8. While the surface layer 8 has a high secondary electron emission coefficient and enables a PDP to be driven with low power, the surface layer 8 has relatively high adsorption properties with respect to impurities such as water, carbon dioxide, and hydrocarbon. Once impurities are adsorbed, initial characteristics of the discharge such as the secondary electron emission characteristics are compromised. By covering the surface layer 8 with the MgO particles 16 in the above-mentioned manner, adsorption of impurities to the surface of the surface layer 8 from the discharge space 15 can be prevented in an area covered with the MgO particles 16. Therefore, the life characteristics of the PDP 1*a* can be expected to be improved.

PDP Manufacturing Method

The following describes an exemplary manufacturing method for the PDPs 1 and 1*a* in Embodiments 1 and 2 respectively. The only substantial difference between the PDPs 1 and 1*a* is the structure of the surface layers 8 and 8*a*. The manufacturing process for other parts is identical.

(Manufacturing of the Back Panel)

On a surface of the back panel glass made of soda-lime glass with a thickness of approximately 2.6 mm, conductive materials mainly containing Ag are applied with the screen printing method in a stripe pattern at a given interval. Thus, the data electrodes with a thickness of some μm (e.g. approximately 5 μm) are formed. The data electrodes 11 are made of a metal such as Ag, Al, Ni, Pt, Cr, Cu, and Pd or a conductive ceramic such as metal carbide and metal nitride. The data electrodes 11 may be made of a composition of these materials, or may have a layered structure of these materials as necessary.

The gap between two adjacent data electrodes is set to approximately 0.4 mm or less so that the PDP 1 has a 40-inch screen in conformity with the NTSC or VGA specification.

Next, a glass paste with a thickness of approximately 20 to 30 μm made of lead-based or lead-free low-melting glass or $SiO_2$ material is applied and baked over the back panel glass on which the data electrodes are formed in order to form the dielectric layer.

Subsequently, the barrier ribs 13 are formed in a predetermined pattern on a surface of the dielectric layer 12. The barrier ribs 13 are formed by applying a low-melting glass paste, and using a sandblast method or a photolithography method to form a grid pattern (see, FIG. 10) dividing the arrays of discharge cells into rows and columns, so as to form borders between adjacent discharge cells (not illustrated).

After the barrier ribs 13 are formed, on the lateral surfaces of the barrier ribs 13 and on the surface of the dielectric layer 12 exposed between the barrier ribs 13, phosphor ink containing one of red (R), green (G), and blue (B) phosphors that are normally used for the AC type PDP is applied. Then, the phosphor ink is dried and baked to form each phosphor layer 14.

The following compositions can be applied in each of the RGB phosphors.

Red phosphor; $(Y, Gd)BO_3$:Eu

Green phosphor; $Zn_2SiO_4$:Mn

Blue phosphor; $BaMgAl_{10}O_{17}$:Eu

As for a form of each phospher material, powders with a mean particle diameter of 2.0 μm are preferred. The phosphor material, ethylcellulose, and solvent (α-terpineol) are injected into a server at 50 percent by mass, 1.0 percent by mass, and 49 percent by mass, respectively, and mixed in a sand mill to manufacture a phosphor ink with a viscosity of $15\times10^{-3}$ Pa·s. This phosphor ink is sprayed by a pump through a nozzle that has a diameter of 60 μm to apply the ink between adjacent barrier ribs 13. At that time, the panel is moved in the longitudinal direction of the barrier ribs 20. Accordingly, the ink is applied in a stripe pattern on the panel. After application is completed, the phosphor ink is baked for 10 minutes at 500° C. to form the phosphor layer 14.

The back panel 9 is completed in the above-mentioned manner.

Although, in the above-mentioned method, the front panel glass 3 and the back panel grass 10 are made of soda-lime glass, the soda-lime glass is just an example of the material. The front and back panel glasses may be made of another material.

(Manufacturing of the Front Panel 2)

On the surface of the front panel glass made of soda-lime glass with a thickness of approximately 2.6 mm, the display electrode pairs 6 are formed. The printing method is shown here as an example to form the display electrode pairs 6. The display electrode pairs 6 may, however, be formed by a die coat method, blade coat method, or the like.

To begin with, on the front panel glass, transparent electrode materials such as ITO, $SnO_2$, and ZnO are applied in a given pattern such as a stripe pattern and dried. Thus, transparent electrodes 41 and 51 with a final thickness of approximately 100 nm are formed.

Meanwhile, a photosensitive paste is prepared by blending Ag powder and an organic vehicle with a photosensitive resin (photodegradable resin). The photosensitive paste is applied on the transparent electrodes 41 and 51, and the transparent electrodes 41 and 51 are covered with a mask having a pattern of the display electrode pairs. After an exposure process on the mask and a development process, the photosensitive paste is baked at a baking temperature of approximately 590° C. to 600° C. Thus, the bus lines 42 and 52 with a final thickness of some μm are formed on the transparent electrodes 41 and 51. Though the screen method can conventionally produce a bus line with a width of 100 μm at best, this photomask method enables the bus lines 42 and 52 to be formed as small as 30 μm.

Besides Ag, the bus lines 42 and 52 can be made of other metal materials such as Pt, Au, Al, Ni, Cr, tin oxide and indium oxide. Other than the above methods, the bus lines 42 and 52 can be formed, after forming a film made of electrode materials by the deposition method or the sputtering method, by etching the film.

Subsequently, a paste is prepared by blending (i) lead-based or lead-free low-melting glass with a softening point of 550° C. to 600° C. or $SiO_2$ powder with (ii) organic binder such as butyl carbitol acetate. The paste is applied on the formed display electrode pairs 6, and baked at a temperature ranging from 550° C. to 650° C. Thus, the dielectric layer 7 with a final thickness of some μm to some tens of μm is formed.

(Formation of the Surface Layer)

The following describes steps for forming the surface layers of the PDPs 1 in Embodiment 1 and 1*a* in Embodiment 2.

At first, a case where the surface layer (base layer) 8 is formed by the electron-beam deposition method is described.

First, a pellet as an evaporation source is prepared. The pellet is manufactured in the following manner. $CeO_2$ powder is mixed with strontium carbonate powder, which is a carbonate of an alkaline-earth metal. The mixture is deposited in a metal mold, and molded by applying pressure. Then, the molded mixture is placed in an alumina crucible, and baked for 30 minutes at approximately 1400° C. to obtain a sintered body, namely, the pellet.

The sintered body, or the pellet, is placed in a deposition crucible in an electron-beam deposition apparatus. By depositing the pellet on the surface of the dielectric layer 7 as the evaporation source, the surface layer 8 including (i) $CeO_2$ and (ii) Sr added such that the concentration of Sr is in a range of 11.8 mol % to 49.4 mol % inclusive, is formed. The concentration of Sr is adjusted, by controlling a ratio of $CeO_2$ to strontium carbonate, in the stage of obtaining the mixture to be placed in the alumina crucible. The surface layer of the PDP 1 is completed after having gone through the above processes.

Besides the electron-beam deposition method, a known method such as, a sputtering method, an ion plating method, or the like can be used to form the surface layer (base layer) 8.

Next, the MgO particles 16 are prepared when the PDP 1*a* is manufactured. The MgO particles 16 can be prepared by either the gas-phase synthesis method or the precursor baking method described below.

(Gas-Phase Synthesis Method)

A magnesium metal material (99.9% pure) is heated in an atmosphere filled with an inert gas. While maintaining the heating, a small amount of oxygen is introduced to the inert gas atmosphere, and the magnesium is directly oxidized, thus creating the MgO particles 16.

(Precursor Baking Method)

Any of the below-listed MgO precursors are baked evenly at a high temperature (e.g., 700° C. or higher) and then cooled, thereby obtaining MgO particles. The MgO precursor can be any one or more (or a mixture of two or more) selected from the group consisting of, for example, magnesium alkoxide ($Mg(OR)_2$), mangensium acetylacetone ($Mg(acac)_2$), magnesium hydroxide ($Mg(OH)_2$), magnesium carbonate, magnesium chloride ($MgCl_2$), magnesium sulfate ($MgSO_4$), magnesium nitrate ($Mg(NO_3)_2$), and magnesium oxalate ($MgC_2O_4$). Note that some of the above compounds may normally be in hydrate form. These compounds in hydrate form may also be used.

The magnesium compound selected as the MgO precursor is adjusted so that MgO obtained after baking has a purity of 99.95% or more, or more preferably 99.98% or more. This is because of the fact that if a certain amount or more of an impurity element such as an alkali metal, B, Si, Fe, or Al is included in the magnesium compound, unnecessary adhesion and sintering occurs during heat processing, thereby making it difficult to obtain highly crystalline MgO particles. For this reason, the precursor is adjusted in advanced by removing impurity elements.

The MgO particles 16 obtained by either of the above methods are dispersed in a solvent. The dispersion liquid is then dispersed on the surface of the completed base layer 8 by a spray method, a screen printing method, or an electrostatic application method. Thereafter drying and baking are performed to eliminate the solvent, and the MgO particles 16 are thus attached to the surface of the surface layer 8.

The surface layer of the PDP 1*a* is formed in the above-mentioned manner.

(Completion of the PDP)

The manufactured front panel 2 and back panel 9 are sealed together at opposing edge portions thereof with the use of sealing glass. Thereafter, the discharge space 15 is evacuated to a high vacuum (approximately $1.0\times10^{-4}$ Pa), and an Ne—Xe based, He—Ne—Xe based, Ne—Xe—Ar based discharge gas or the like is enclosed in the discharge space 15 at a predetermined pressure (here, 66.5 kPa to 101 kPa).

The PDPs 1 and 1*a* are completed after having gone through the above processes.

(Performance Confirmation Experiments)

Next, in order to confirm performance of the present invention, the following PDP samples 1 to 14 were prepared. The basic structures of these PDP samples are the same. The structures of the surface layers in these PDP samples, however, are different with one another.

As a way of expressing the amount of Sr included in the surface layer (base layer) that includes $CeO_2$ as the main component, Sr/(Sr+Ce)*100 (hereinafter, described as "$X_{Sr}$") is used. This indicates a ratio of the number of Sr atoms to the total number of Ce and Sr atoms.

Note that, although a unit of $X_{Sr}$ can be represented by both (%) and (mol %), hereinafter (mol %) is used for the sake of convenience.

The samples 1 to 10 (working examples 1 to 10) correspond to the structure of the PDP 1 in Embodiment 1.

The samples 1 to 4 (working examples 1 to 4) of these samples have surface layers made by adding Sr to $CeO_2$. $X_{Sr}$s of the surface layers included in the samples 1 to 4 are 11.8 mol %, 15.7 mol %, 22.7 mol %, and 49.4 mol %, respectively.

The sample 11 (working example 5) has a surface layer including a base layer and predetermined MgO particles disposed on the base layer, and corresponds to the structure of the PDP 1*a* in Embodiment 2. Specifically, the sample 11 (working example 5) has the surface layer including (i) a base layer that is made by adding Sr to $CeO_2$ such that $X_{Sr}$ is 49.4 mol % and (ii) the MgO particles that are produced by the precursor baking method and dispersed on the base layer.

On the other hand, the sample 12 (comparative example 1) has the most basic structure of the conventional PDP. The sample 12 (comparative example 1) has a surface layer made of magnesium oxide formed by the EB deposition method (Ce is not included).

The samples 13 and 14 (comparative examples 2 and 3) have surface layers made by adding Sr to $CeO_2$. $X_{Sr}$s of the surface layers included in the samples 13 and 14 are 1.6 mol % and 8.4 mol %, respectively.

The samples 15 to 20 (comparative examples 4 to 9) have surface layers made by adding Sr to $CeO_2$. $X_{Sr}$s of the surface layers included in the samples 15 to 20 are 54.9 mol %, 63.9 mol %, 90.1 mol %, 98.7 mol %, 99.7 mol %, and 100 mol %, respectively.

The structures of the surface layers in the samples 1 to 20 and experimental data obtained by using these samples are shown in the following Tables 1 and 2.

TABLE 1

| | Film Sr concentration, $X_{Sr}$ Sr/(Sr + Ce)*100 (mol %) | Film state | MgO particles | Ratio of carbonate (%) | Discharge voltage (v) (Xe15% 450 torr) | Aging time (time) | Discharge delay* |
|---|---|---|---|---|---|---|---|
| Sample 1 (Working Example 1) | 11.8 | $CeO_2$ | Not disposed | 29.8 | 161 | 60 | Δ |
| Sample 2 (Working Example 2) | 15.7 | $CeO_2$ | Not disposed | 32.4 | 154 | 30 | Δ |
| Sample 3 (Working Example 3) | 22.7 | $CeO_2$ | Not disposed | 35.3 | 154 | 30 | Δ |
| Sample 4 (Working Example 4) | 25.7 | $CeO_2$ | Not disposed | | 140 | 30 | Δ |
| Sample 5 (Working Example 5) | 29.0 | $CeO_2$ | Not disposed | | 136 | 30 | Δ |
| Sample 6 (Working Example 6) | 34.2 | $CeO_2$ | Not disposed | | 141 | 30 | Δ |
| Sample 7 (Working Example 7) | 40.0 | $CeO_2$ | Not disposed | | 138 | 30 | Δ |
| Sample 8 (Working Example 8) | 42.1 | $CeO_2$ | Not disposed | | 140 | 30 | Δ |
| Sample 9 (Working Example 9) | 42.9 | $CeO_2$ | Not disposed | | 139 | 30 | Δ |
| Sample 10 (working Example 10) | 49.4 | $CeO_2$ | Not disposed | | 150 | 30 | Δ |
| Sample 11 (Working Example 11) | 29.0 | $CeO_2$ | Disposed | | 137 | 30 | ○ |

*"○" indicates that an effect of reducing discharge delay is favorable, and "Δ" indicates that the effect is less favorable than that shown in "○".

TABLE 2

| | Film Sr concentration, $X_{sr}$ Sr/(Sr + Ce) * 100 (mol %) | Film state | MgO particles | Ratio of carbonate (%) | Discharge voltage (v) (Xe15% 450 torr) | Aging time (time) | Discharge delay* |
|---|---|---|---|---|---|---|---|
| Sample 12 (Comparative Example 1) | — | MgO | Not disposed | 20.5 | 185 | 30 | Δ |
| Sample 13 (Comparative Example 2) | 1.6 | $CeO_2$ | Not disposed | 21.2 | 173 | 240 | X |
| Sample 14 (Comparative Example 3) | 8.4 | $CeO_2$ | Not disposed | 26.7 | 161 | 120 | Δ |
| Sample 15 (Comparative Example 4) | 54.9 | Amorphous | Not disposed | 52.5 | 219 | Not finished within 7 h | X |
| Sample 16 (Comparative Example 5) | 63.9 | SrO | Not disposed | 49.7 | 206 | Not finished within 7 h | X |
| Sample 17 (Comparative Example 6) | 90.1 | SrO | Not disposed | 66.4 | 215 | Not finished within 7 h | X |
| Sample 18 (Comparative Example 7) | 98.7 | SrO + $Sr(OH)_2$ | Not disposed | 70.1 | 230 | Not finished within 7 h | X |
| Sample 19 (Comparative Example 8) | 99.7 | $Sr(OH)_2$ | Not disposed | 58.5 | 221 | Not finished within 7 h | X |
| Sample 20 (Comparative Example 9) | 100.0 | $Sr(OH)_2$ | Not disposed | 64.1 | 225 | Not finished within 7 h | X |

*"Δ" indicates that an effect of reducing discharge delay is less favorable than that shown in "○", and "X" indicates that the effect is not shown.

[Experiment 1] Film Property Evaluation (Crystalline Structure Analysis)

Figure 7:
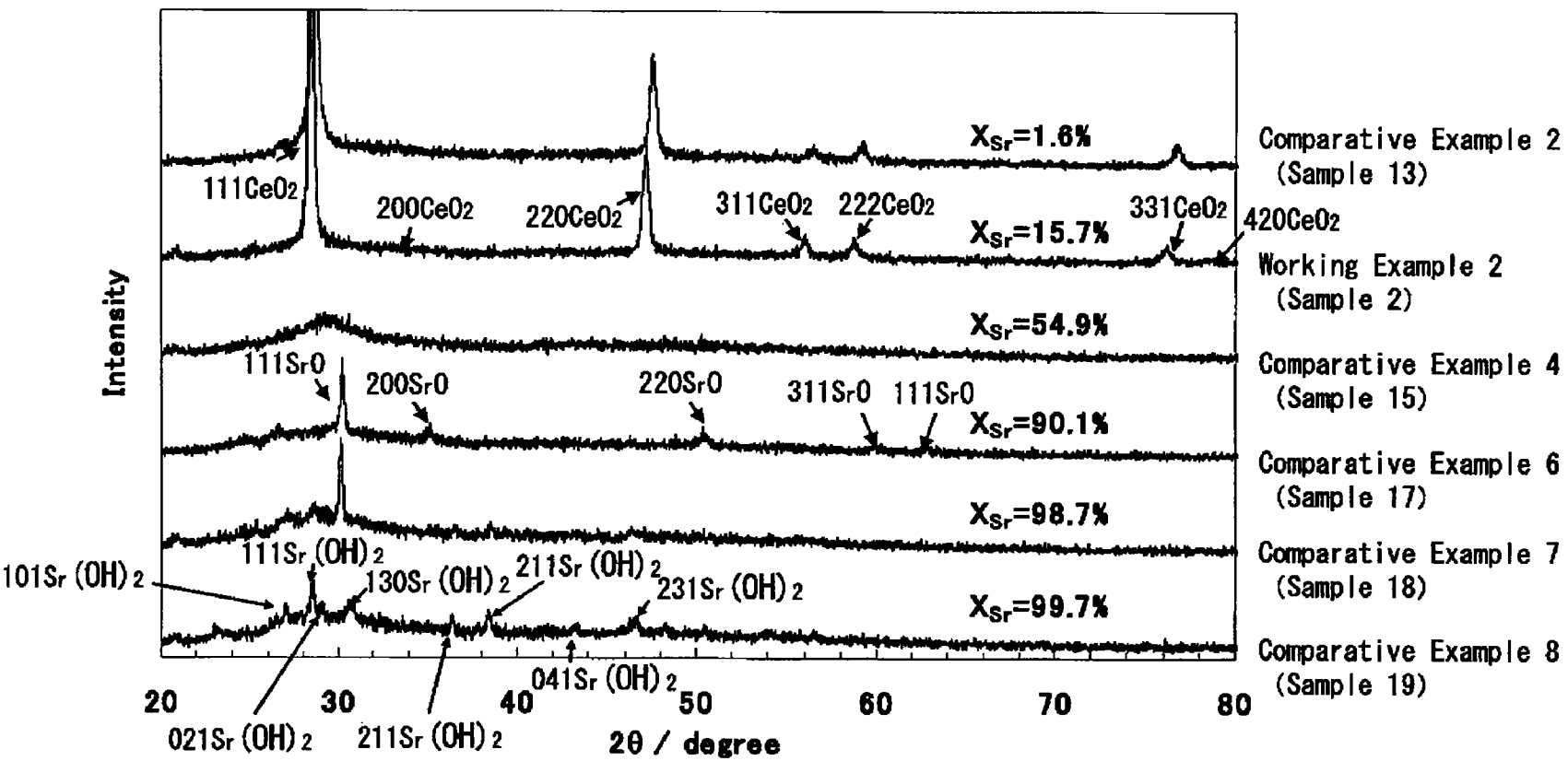
FIG. 7 is a graph showing X-ray diffraction results of samples in which varying concentration of Sr is added to $CeO_2$.

In order to examine crystalline structures of the above-mentioned samples, θ/2θ X-ray diffraction measurement was carried out. FIG. 7 shows results of the measurement, and Tables 1 and 2 show the analysis results thereof. FIG. 7 shows profiles of the samples 13, 2, 15, 17, 18, and 19 that have surface layers whose $X_{Sr}$s are 1.6 mol %, 15.7 mol %, 54.9 mol %, 90.1 mol %, 98.7 mol %, and 99.7 mol %, respectively.

As shown in FIG. 7, in the samples 13 and 2 that have surface layers whose $X_{Sr}$s are relatively low (1.6 mol % and 15.7 mol %, respectively), the existence of only $CeO_2$ having a fluorite structure was confirmed.

According to the measurement results shown in FIG. 7, in the sample 15 that has the surface layer whose $X_{Sr}$ is 54.9 mol %, a peak cannot be identified. Based on this, the sample 15 is considered to have an amorphous structure. A possible reason for the change to the amorphous structure is as follows. Although a crystalline structure of a surface layer changes from an NaCl structure to a fluorite structure with increasing $X_{Sr}$, when $X_{Sr}$ is in a certain range including a value of $X_{Sr}$ in the sample 15, the surface layer can have neither of these crystalline structures. Consequently, the crystalline structure collapses, and changes to the amorphous structure.

On the other hand, in the sample 18 that has the surface layer whose $X_{Sr}$ reaches approximately 98 mol % and includes a large amount of Sr, a peak of $Sr(OH)_2$ was detected. This is thought to be because the surface layer that had been SrO immediately after the formation was hydroxylated by being exposed to the air before or during the measurement. As in this case, it was found that the stability of the surface layer is extremely degraded when $X_{Sr}$ is approximately 98 mol % or more.

In contrast to the above sample 18, it was confirmed that the sample 17 having the surface layer whose $X_{Sr}$ is 90.1 mol % forms a single layer structure of SrO. This suggests that, by adding SrO to Ce such that the concentration of Sr is 10 mol %, the hydroxylation of SrO can be prevented and the surface stability is improved.

Next, $X_{Sr}$ dependency of lattice constants was examined after obtaining the lattice constants of each crystalline structure from the results of the X-ray diffraction. Results of the examination are shown in FIG. 8.

Figure 8:
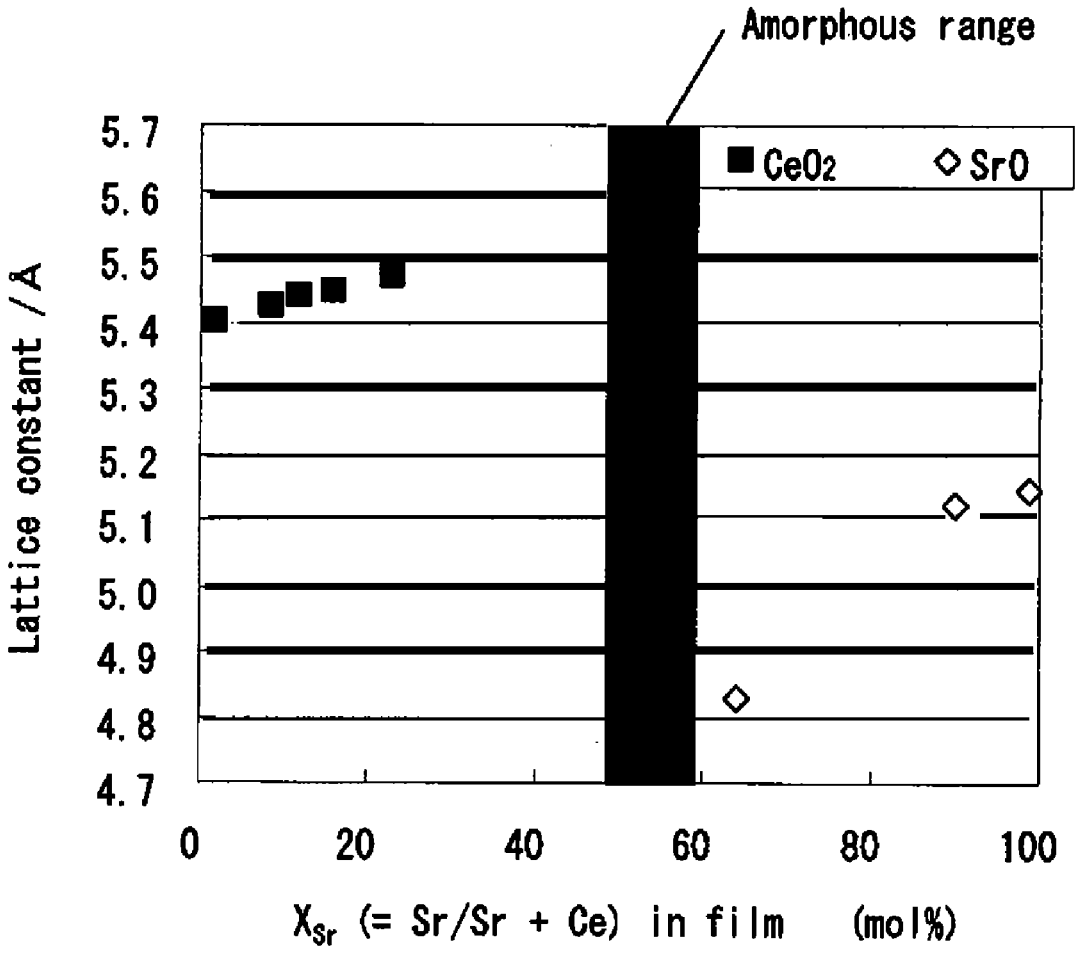
FIG. 8 is a graph showing Sr concentration dependency of lattice constants, which is obtained through the X-ray diffraction.

The results shown in FIG. 8 demonstrate that the surface layers whose $X_{Sr}$s range from approximately 0 mol % to 30 mol % have crystalline structures of $CeO_2$, and the lattice constants increase as the values of $X_{Sr}$ increase. This suggests that, at least when $X_{Sr}$ is 30 mol % or less, Sr is dissolved in $CeO_2$. The increase of the lattice constants can be explained by the fact that the ionic radius of Sr is greater than the ionic radius of Ce.

By contrast, it was confirmed that the surface layers whose $X_{Sr}$s range from 60 mol % to 100 mol % have crystalline structures of SrO.

Furthermore, the surface layers whose $X_{Sr}$s range from 50 mol % to 60 mol % have amorphous structures, and do not have any of the crystalline structures.

The results demonstrate that, in order to have the fluorite structure, the value of $X_{Sr}$ is required to be less than 50 mol %.

[Experiment 2] Surface Stability Evaluation

In general, when a large amount of carbonate is included in the surface layer, secondary electron emission characteristics inherent to the surface layer cannot be exhibited, resulting in an increase in operating voltage. In order to prevent the large amount of carbonate from being included in the surface layer, an aging process is necessary. In the aging process, PDPs are discharged for a certain period of time before being shipped to market to remove contaminant on the surface layer. Given the productivity of PDP manufacturing, it is desired that the aging process is finished in a short time. Therefore, it is preferred that carbonate in the surface layer is removed as much as possible before the aging process.

In order to examine the stability of the surface of the surface layer, experiment 2 was carried out. In experiment 2, the inventors examined the degrees of adsorption of carbonate as impurity in each sample including $CeO_2$ and Sr. The amount of carbonate included in the surface of the surface layer was measured based on X-ray photoelectron spectroscopy (XPS). The surface layer in each sample is exposed to the air for a certain period of time after formation, placed on a plate for measurement, and then injected into an XPS measurement chamber. Since the surface of the surface layer is expected to be carbonized during the exposure to the air, the time required for the exposure to the air is set for 5 minutes so that the samples are processed under the same conditions.

"QUANTERA" manufactured by ULVAC-PHI was used as an XPS measurement device. Al—Kα was used as an X-ray source, and a monochromator was used. Insulating experiment samples were neutralized by using a neutralizing gun and an ion gun. In the experiment, energy in regions corresponding to Mg2p, Ce3d, C1s, and O1s are measured through 30 cycles of estimation. From a peak area of a spectrum obtained in the measurement and a sensitivity coefficient, elemental composition of the surface of the surface layer is derived. Waveform separation of a C1s spectral peak into a spectral peak detected in the vicinity of 290 eV and a spectral peak of C and CH detected in the vicinity of 285 eV is performed, and a ratio of each of the spectral peaks is obtained. Then, the amount of CO in the surface of the surface layer is obtained from the product of C composition and a ratio of CO to the C composition. By using the amounts of CO in the surfaces of the surface layers in the samples obtained by the XPS, stabilities of the surfaces of the surface layers, namely, degrees of carbonation are compared.

Figure 9:
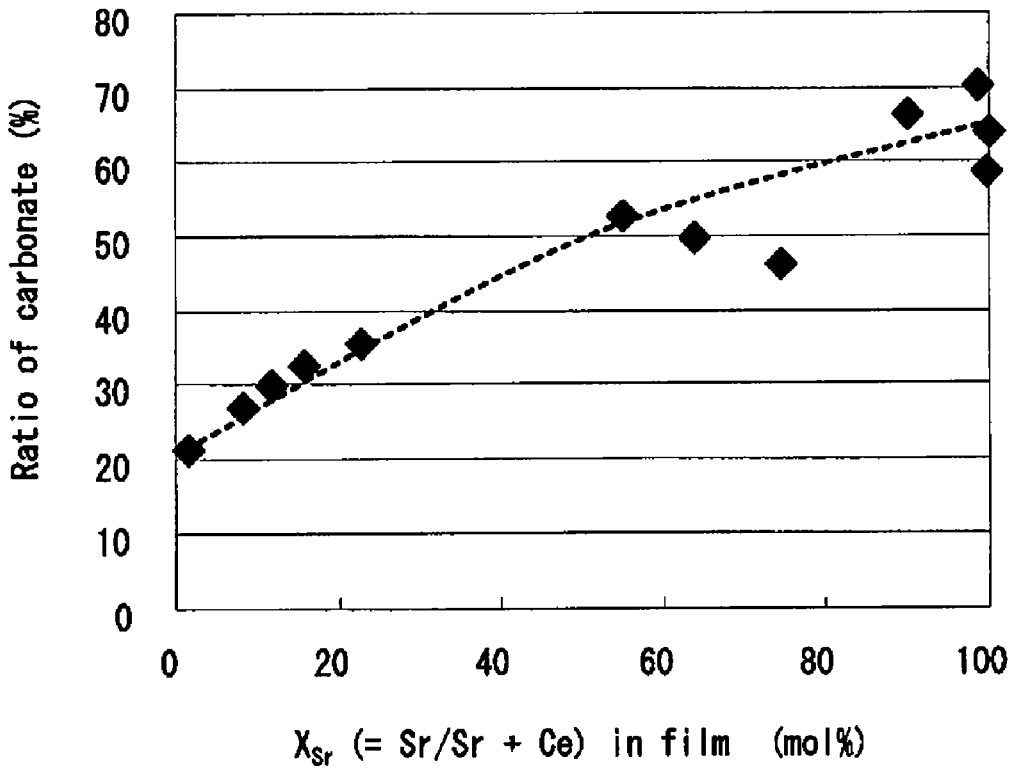
FIG. 9 is a graph showing dependency of a ratio of carbonate to a surface on Sr concentration in $CeO_2$, which is obtained through the X-ray diffraction.

The XPS measurement was carried out under the above-mentioned conditions. FIG. 9 is a graph in which ratios of carbonate to the surface are plotted.

As can be seen from a curve shown in FIG. 9, in order to keep the ratio of carbonate to the surface layer at least 50 mol % or less, it is desired that $X_{Sr}$ be reduced to approximately 50 mol % or less.

The result suggests that the preferred upper limit of $X_{Sr}$ in the surface layer is 50 mol % or less, in order to prevent impurities from being incorporated into the surface layer as much as possible and reduce a time required for the aging process.

[Experiment 3] Discharge Characteristics Evaluation (Discharge Voltage)

In order to examine characteristics of operating voltage of the above samples, the PDP samples were produced by using Xe—Ne mixed gas with the Xe partial pressure of 15% as a discharge gas, and sustain voltage of the PDP samples were measured.

Figure 10:
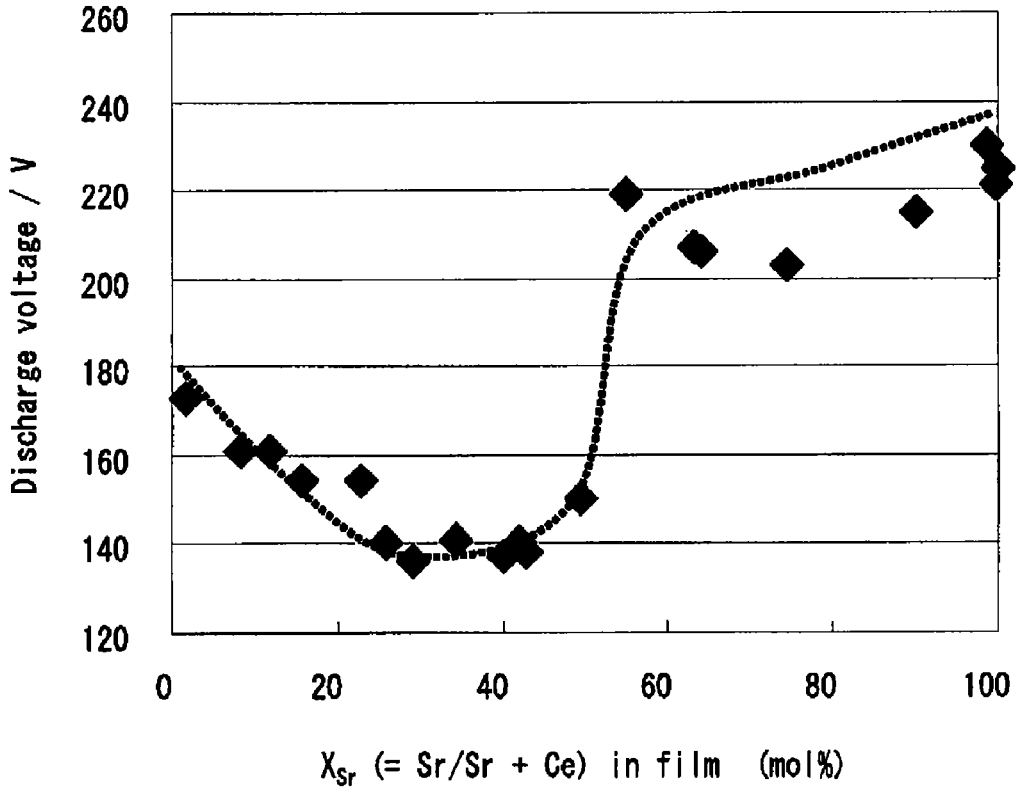
FIG. 10 is a graph showing dependency of discharge voltage on Sr concentration in $CeO_2$ when the partial pressure of Xe is 15%.

FIG. 10 is a graph in which values of sustain voltage for $X_{Sr}$s of the surface layers measured under the above-mentioned conditions are plotted.

As shown in FIG. 10 and Table 1, when $X_{Sr}$ is in a range of 11.8 mol % to 49.4 mol % inclusive, since sustain voltage is reduced from approximately 175 V to 160 V or less, it was confirmed that the driving of a PDP with low power is promoted. Furthermore, when $X_{Sr}$ is in a range of 25.7 mol % to 42.9 mol % inclusive, since discharge voltage is reduced to approximately 150 V, it is considered that the driving of a PDP with low power can be further promoted.

This is thought to be because, by adding Sr, a level of the valence band in the surface layer is elevated. As a result, secondary electron emission characteristics are improved.

On the contrary, when $X_{Sr}$ exceeds 49.4 mol %, it was confirmed that discharge voltage is increased. This is thought to be because the surface comes to have a structure in which SrO is included as the main component, and the surface layer is contaminated, for example, by unnecessary $Sr(OH)_2$ formed in the surface layer in a process of manufacturing a panel as described above.

These results show that too large amount of Sr included in the surface layer is undesirable, and there is an adequate concentration range.

(Aging Behavior)

Figure 11:
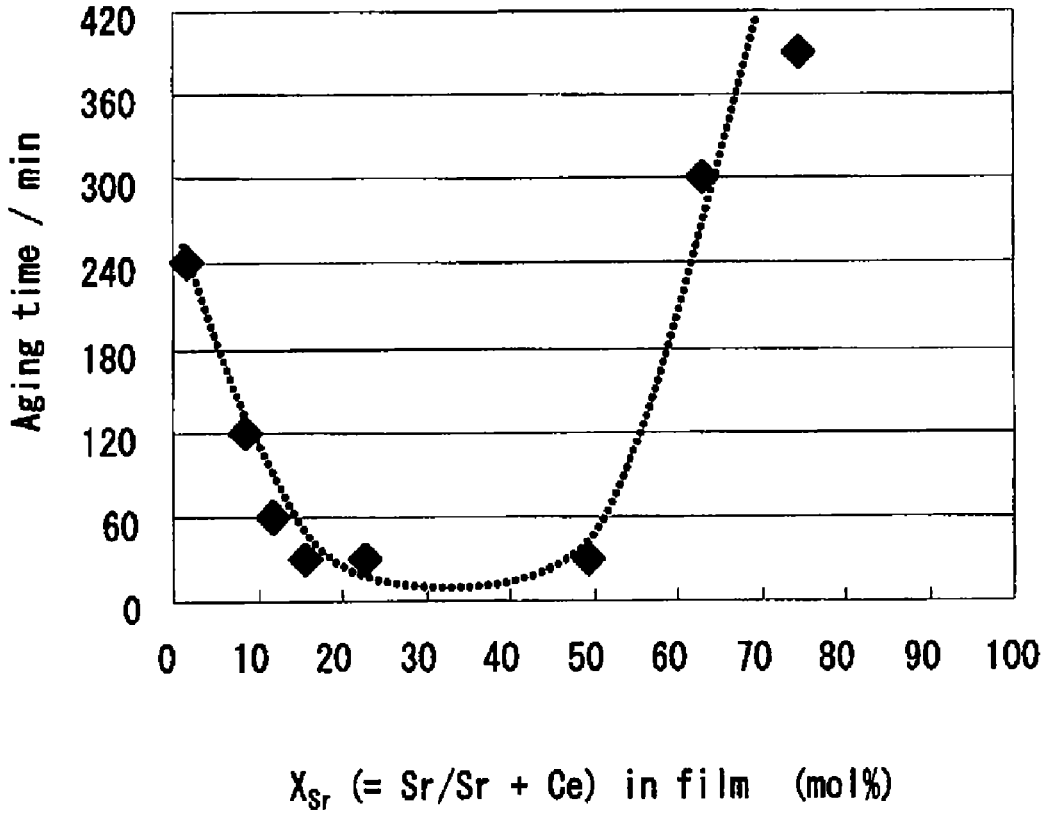
FIG. 11 is a graph showing dependency of an aging time on Sr concentration in $CeO_2$ when the partial pressure of Xe is 15%.
Figure 12:
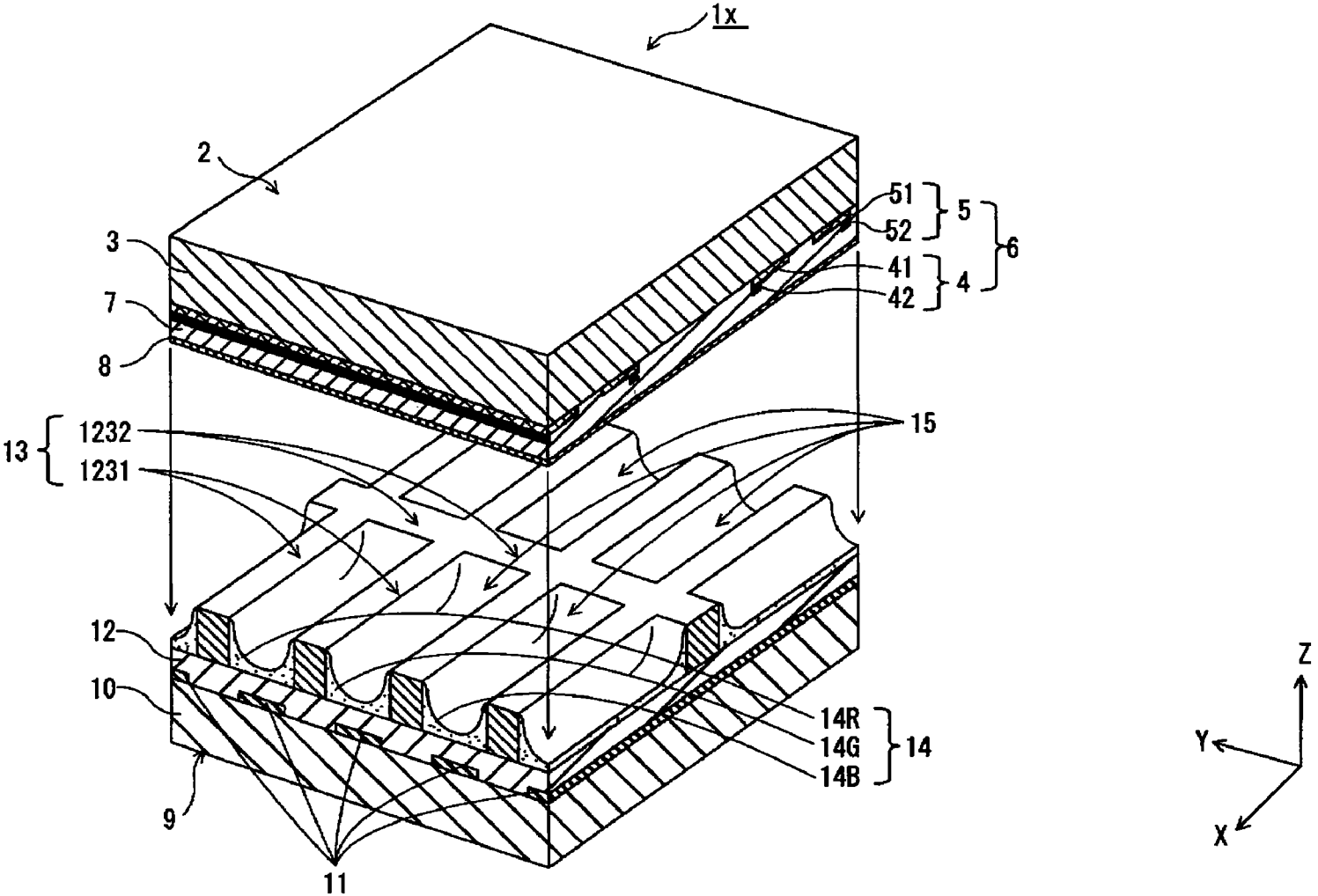
FIG. 12 is a schematic view showing a general structure of a conventional PDP.

$X_{Sr}$ dependency of the aging time in each PDP sample is shown in FIG. 11, Table 1, and Table 2. The "aging time" here refers to a time until discharge voltage reaches at a saturation level, and a time until the discharge voltage reaches at a level 5% higher than bottom voltage.

As can be seen from FIG. 11, when $X_{Sr}$ is in a range corresponding to working examples 1 to 10 (in a range of 11.8 mol % to 49.4 mol % inclusive), aging is finished within 120 minutes, while approximately 240 minutes were taken for the aging when the surface layer includes $CeO_2$ alone. Furthermore, $X_{Sr}$ in a range of 25.7 mol % to 42.9 mol % (corresponding to working examples 4 to 9) inclusive, is preferred because the aging time can be reduced to approximately 20 minutes.

Presumably, this can be explained by the following reason. In $CeO_2$, a long time is required to stably emit electrons at an electron level in a forbidden band. By adding Sr such that the concentration of Sr is in a range of 11.8 mol % to 49.4 mol % inclusive, or, more preferably, in a range of 25.7 mol % to 42.9 mol % inclusive, secondary electron emission is not dominated by electrons at an electron level in a forbidden band but dominated by electrons in a stable valence band. Therefore, the aging time is reduced.

The results shown in FIG. 11, and Tables 1 and 2 demonstrate that, in terms of the aging time, it is preferable that $X_{Sr}$ falls within a range of 25.7 mol % to 42.9 mol % inclusive.

(Measurement of Discharge Delay)

Next, by using the same discharge gas as the above-mentioned discharge gas, degrees of discharge delay in the write discharge were evaluated in the sample 11 (working example 11) that has the surface layer including a base layer and MgO particles disposed on the base layer. The evaluation method involved applying a pulse corresponding to an initialization pulse in the exemplary drive waveform shown in FIG. 3 to one arbitrary cell in each of the PDP samples 1 to 20, and thereafter measuring a statistical delay in discharge when a data pulse and scan pulse are applied.

As a result, it was found that, in the sample 11 (working example 11) that has the surface layer including a base layer and MgO particles disposed on the base layer, the occurrence of the discharge delay is effectively reduced compared with the other samples 1 to 10, and 12 to 20.

As described above, an effect of preventing discharge delay in a PDP is further improved by disposing MgO particles on the base layer. Note that the MgO particles produced by the precursor baking method are more effective than the MgO particles produced by the gas phase method. Accordingly, the precursor baking method is a method of producing MgO particles suitable for the present invention.

As shown by the experimental data of the sample 11 (working example 11), by constructing the surface layer composed of (i) the surface layer having a predetermined Sr concentration and (ii) the MgO particles disposed on the surface layer, a PDP that can be driven with low power and rarely cause the discharge delay can be obtained.

INDUSTRIAL APPLICABILITY

The PDP of the present invention can be used in, for example, gas discharge panels that are driven at low voltage and display high definition images. In addition, the PDP of the present invention is also applicable to information display apparatuses in transportation facilities and public facilities, television apparatuses or computer displays in homes and offices.

REFERENCE SIGNS LIST

1, 1*x* PDP
2 front panel
3 front panel glass
4 sustain electrode
5 scan electrode
6 display electrode pairs
7, 12 dielectric layer
8, 8*a* surface layer (high γ film)
9 back panel
10 back panel glass
11 data (address) electrode
13 barrier ribs
14, 14R, 14G, 14B phosphor layer
15 discharge space
16 MgO particles

The invention claimed is:

1. A plasma display panel having a first substrate and a second substrate that oppose each other and are sealed together at opposing edge portions thereof so as to enclose a discharge space, the first substrate including a plurality of display electrode pairs, the discharge space being filled with a discharge gas, wherein the first substrate includes a surface layer at a side thereof facing the discharge space, the surface layer including $CeO_2$ and Sr, a concentration of Sr in the surface layer being in a range of 11.8 mol % to 49.4 mol % inclusive.

2. The plasma display panel of claim 1, wherein the concentration of Sr in the surface layer is in a range of 25.7 mol % to 42.9 mol % inclusive.

3. The plasma display panel of claim 1, wherein the first substrate includes MgO particles disposed on the surface layer so as to face the discharge space.

4. The plasma display panel of claim 3, wherein the MgO particles are produced by a gas phase oxidation method.

5. The plasma display panel of claim 3, wherein the MgO particles are produced by baking MgO precursors.

* * * * *